US011476062B2

(12) United States Patent
Jimenez Pavon et al.

(10) Patent No.: US 11,476,062 B2
(45) Date of Patent: Oct. 18, 2022

(54) WATERPROOF ELECTRIC SWITCH ASSEMBLY

(71) Applicant: PREMO, SA, Campanillas (ES)

(72) Inventors: Jose Antonio Jimenez Pavon, Torremolinos (ES); Juan Fernandez Reina, Alhaurin de la Torre (ES); Antonio Rojas Cuevas, Malaga (ES); Francisco Ezequiel Navarro Perez, Barcelona (ES)

(73) Assignee: PREMO, SA, Campanillas (ES)

( * ) Notice: Subject to any disclaimer, the term of this patent is extended or adjusted under 35 U.S.C. 154(b) by 0 days.

(21) Appl. No.: 17/599,894

(22) PCT Filed: Apr. 15, 2020

(86) PCT No.: PCT/EP2020/060563
§ 371 (c)(1),
(2) Date: Sep. 29, 2021

(87) PCT Pub. No.: WO2020/212406
PCT Pub. Date: Oct. 22, 2020

(65) Prior Publication Data

US 2022/0102089 A1 Mar. 31, 2022

(30) Foreign Application Priority Data

Apr. 17, 2019 (EP) ..... 19382308

(51) Int. Cl.
*H01H 13/06* (2006.01)
*H01H 13/14* (2006.01)
*H01H 13/20* (2006.01)

(52) U.S. Cl.
CPC ..... *H01H 13/06* (2013.01); *H01H 13/14* (2013.01); *H01H 13/20* (2013.01)

(58) Field of Classification Search
CPC ..... H01H 13/14; H01H 13/20; H01H 13/04; H01H 13/50; H01H 13/52; H01H 13/86;
(Continued)

(56) References Cited

U.S. PATENT DOCUMENTS 7,230,196 B2 * 6/2007 Toyama ..... H01H 13/023 200/341
8,822,857 B2 * 9/2014 Cho ..... H01H 13/06 200/302.1
(Continued)

FOREIGN PATENT DOCUMENTS

CN 102264991 A 11/2011
DE 102016013790 A1 5/2017
(Continued)

OTHER PUBLICATIONS

International Search Report and Written Opinion for PCT/EP2020/060563 dated Jun. 16, 2020.
(Continued)

*Primary Examiner* — Lheiren Mae A Caroc
(74) *Attorney, Agent, or Firm* — Lucas & Mercanti, LLP

(57) ABSTRACT

A waterproof electric push button switch assembly having a closed compartment and an electric switch housed inside the closed compartment, the electric switch having connected thereto cables coming out of the compartment which is arranged inside a casing with a cavity with two openings, a first opening hermetically sealed by a compressible elastomeric body attached to the casing, and a second opening hermetically sealed by a cover. The elastomeric body extends into the cavity of the casing providing a surface supporting the electric switch and the cover has on its inner face a tubular wall which is inserted into the cavity of the
(Continued)

casing and contacts the elastomeric body along the perimeter. The tubular wall completely surrounds the switch and assures its waterproofness.

13 Claims, 2 Drawing Sheets

(58) Field of Classification Search
CPC ..... H01H 9/02; H01H 9/04; H01H 2009/048; H01H 2223/00; H01H 2223/002; H01H 2223/003; H01H 13/06
See application file for complete search history.

(56) References Cited

U.S. PATENT DOCUMENTS

| | | | | |
|---|---|---|---|---|
| 8,822,863 | B2 | 9/2014 | Tittle | |
| 9,761,388 | B2 * | 9/2017 | Kitahara | H01H 13/06 |
| 2011/0254290 | A1 | 10/2011 | Cho | |
| 2011/0284351 | A1 | 11/2011 | Kitahara | |

FOREIGN PATENT DOCUMENTS

| | | | |
|---|---|---|---|
| DE | 202016107304 | U1 | 3/2018 |
| EP | 1032004 | A2 | 8/2000 |
| JP | 3046865 | U | 3/1998 |
| JP | 2009146806 | A | 7/2009 |
| JP | 2012009419 | A | 1/2012 |
| JP | 2012150916 | A | 8/2012 |

OTHER PUBLICATIONS

Search Report for Corresponding Chinese Application No. 2020800295016, 3 pages.
Office Action for Corresponding Korean Application No. 10-2021-7037398, dated Feb. 15, 2022, 6 pages, English translation 4 pages.
Office Action for Corresponding Japanese Application No. 2021-559721, dated Mar. 3, 2022, 11 pages.

* cited by examiner

WATERPROOF ELECTRIC SWITCH ASSEMBLY

CROSS REFERENCE TO RELATED APPLICATION

This Application is a 371 of PCT/EP2020/060563 filed on Apr. 15, 2020, which claims priority of European Patent Application No. 19382308.5 filed Apr. 17, 2019, both of which are incorporated herein by reference.

FIELD OF THE ART

The present invention relates to a waterproof electric switch assembly particularly resistant to contact with water.

Insulating electrical and electronic components, particularly switches, is of utmost importance today. In that sense, electrical and electronic devices are subjected to increasingly more stringent testing in terms of in-use operation, where they have to withstand combined tests in which immersion in water, pressurized water, and saline vapor are among the most rigorous tests to assure that water does not penetrate the components or affect said components in the event of minimal penetration.

Moreover, in the automotive sector today optimization, miniaturization, chemical adhesive reduction, and use of recyclable, easy-to-manufacture material are vital, in addition to the functionality of the switch device to achieve proper sealing thereof, preventing water from penetrating and reaching the switch device.

STATE OF THE ART

One of the most widely used systems today for protecting an electric switch is to perform overmolding with a thermoplastic which, despite being an expensive system, fails to close all the water entryways into the internal electrical or electronic components.

U.S. Pat. No. 8,822,863-B2 discloses a sealed switch that is resistant to water and/or moisture penetration, said switch being formed by a casing 2 defining a cavity in which there is housed a PCB assembly formed by: a PCB 6, a tactile electric switch 7, other components such as capacitors 8 or resistors 9 and cables 13 e through an opening 14 of the casing 2.

The casing 2 has an upper opening 2A sealed by means of an elastomeric push button 3, and a lower opening 2U sealed by means of a moldable injected material 11, with the casing 2 being completely sealed.

According to one embodiment the push button 3 can be overmolded with respect to the casing 2 during an injection/molding process, thereby sealing the upper opening 2A, whereas the moldable material 11, preferably a polyamide (TPE-A), is injected once the PCB assembly 5 has been inserted into the casing 2, creating an adhesive attachment between said moldable material 11 and the push button 3, the casing 2 and the PCB assembly 5, thereby sealing the lower opening 2U and the opening 14 of the casing 2 once it has solidified, adopting the shape of the inner cavity of the casing 2.

Furthermore, when the moldable material 11 is injected into the cavity of the casing 2, it creates a seal around the cables 13.

A hermetic push button switch made in a similar manner by means of a push button part overmolded with respect to an upper portion of a casing housing a switch and a lower portion of the casing filled with an epoxy resin is also described in patent application DE102016013790A1.

DE 202016107304 U1 discloses a hand-held transmitter with improved protection against water, in particular improved water jet protection, and safe switching behavior, comprising two shells configured to be coupled with interposition of an elastic sealing block 60, delimiting a housing and including an upper shell 70, with a peripheral skirt 75 and one lower shell 10, with a peripheral skirt 14. The first of these shells 70 has openings 71 through which there are some keypads 53 of some keys 51 that are part of the elastic sealing block 60, which is placed between the two housings. The keys 52 are designed to operate switches (of a switching mat 50) supported by a printed circuit board 30.

EP 1032004A2 discloses a waterproof switching device having a body formed of two parts 31, 32 that are clipped together. The lower shell 32 has an upstanding peripheral flange 33 with an inwardly-projecting lip portion 34 for clippingly engaging with a corresponding portion 35 of the upper part 31 to form a case. An elastomeric operating member 36 in the form of an elastomeric button protrudes through a hole of the upper part 31 and has a downward protrusion 37 for operating the circuit device 11. The button 36 extends along the inner wall of the upper part 31 and is overmoulded to that wall to form a seal therewith. The lower part 32 of the case has a further upstanding rib 38 which, when the two parts are clipped together, is urged against an end face 39 of the elastomer to retain it in place.

Although the technique of overmolding the push button body described in the mentioned patent documents dispenses with the need for using special adhesives or coatings, it is observed that a casing sealing operation by means of injecting or filling with a mass that must consolidate inside the cavity of the casing is still being used, causing the operation of assembling the switch to be a complex and costly one.

The present invention proposes a solution in which filling the casing of the switch with a resin or the like is prevented, providing watertightness by means of a physical barrier obtained as a result of interference between a continuous wall which is derived from a closure cover of an opening of the casing and the elastomeric body which is used to form the push button, said wall surrounding the area where the switch is located.

BRIEF DESCRIPTION OF THE INVENTION

As indicated, the invention seeks to solve problems relating to the lack of watertightness of electronic products and how these products are affected by corrosion and other problems such as short circuits, etc.

The proposed solution avoids the use of adhesives, thereby eliminating problems such as bubbles and bubble detection difficulty, lack of cross-linking, homogeneity oversights, etc. Moreover, the proposed solution makes it easier to put together the switch assembly, increases system reliability and assembly stability, increasing the number of water barriers and accordingly safety in relation to watertightness.

The proposed structure allows improving the resistance to both temperature and water by only changing at the same time the elastic material under compression, this material being the one that can be selected using TPEs (thermoplastic elastomers) suitable for low temperature ranges or silicones (LSR) for higher resistance at large temperature ranges with low creep deformation and low compression set.

The waterproof electric switch assembly of this invention comprises:

a closed compartment; and an electric switch housed inside said closed compartment and having connected thereto electrical conductors;

said closed compartment being arranged inside a casing defining a cavity with two openings, a first opening which is hermetically sealed by a compressible elastomeric body which is attached to said casing, and the second opening is hermetically sealed by a cover, all of this according to the already known prior art disclosed particularly in document U.S. Pat. No. 8,822,863-B2.

With respect to this known structure of a switch assembly, the present invention is characterized in that the mentioned compressible elastomeric body extends partially into the cavity of the casing providing a surface on which the switch is arranged, for example, fitted thereon, the mentioned closure cover of the second opening of the casing further comprising on its inner face at least one tubular wall (of any suitable cross-section) which is inserted into the cavity and establishes a perimetral interference contact with said surface of the elastomeric body (which it presses along the entire contour thereof), this tubular wall of the cover completely surrounding the switch and thereby assuring its waterproofness. In other words, this tubular wall of the inner face of the cover provides an additional barrier when closing the cover of the second opening of the casing which provides access to the inner cavity housing the switch.

This solution can be implemented through a rigid casing, with said first and second openings arranged opposite one another and the elastomeric body attached to the first opening of the casing by overmolding, comprising an annular flange which is placed against a part of the inner face of the casing surrounding said first opening and defining said support surface for the switch.

It has furthermore been envisaged that the elastomeric body has attached thereto by overmolding an outer part configured as a push button.

In a second embodiment, the compressible elastomeric body does not have to be overmolded, which reduces the cost and operations for putting it together, likewise providing effective watertightness.

In this second embodiment, a rigid casing is likewise used, with said first and second openings arranged opposite one another and the compressible elastomeric body, in this case, introduced in the casing, emerging through the first opening, and with a bend of the elastomeric body with a flat portion placed against a part of the inner face of the casing surrounding said first opening, said flat face of the elastomeric body being pressed by said tubular wall of the inner face of the cover. In this second embodiment, the elastomeric body further comprises a tubular wall extending towards the outside of the cavity of the casing, emerging from said bend, until establishing a perimetral interference contact with the inner face of said closure cover of the second opening, the free edge (with a rounded transverse profile) of this tubular wall pressing on said inner face.

In this second embodiment, the tubular walls of the elastomeric body and of the cover are of different width and located very close to one another in an arrangement in which are they are fitted together, so they provide a double watertight barrier.

In this second embodiment, given that the elastomeric body is not attached to the body of the casing by overmolding, it is not necessary to use elastomers that are compatible with the material of the casing, which is generally a polymer material, so any elastomer available on the market can be used depending on the technical requirements of the application.

The elastomeric body is made of an elastomeric thermoplastic material functionally operative in a temperature range of −85° C. to +85° C.

The mentioned electric switch preferably comprises a printed circuit board which supports an electrical or electronic switch component or device and to which there are connected by welding the ends of two insulated electrical conductors which are prolonged to the outside of the casing passing through said elastomeric body, said printed circuit board being fitted in a recessed portion of said elastomeric body, located inside the cavity of the casing and being surrounded by a perimetral wall providing watertightness function or by two walls in the case of the described second embodiment.

The two insulated electrical conductors that converge in the switch exit to the outside through a side window of the casing which is occupied by an extension of said elastomeric body, and through which said insulated electrical conductors pass, such that an arrangement of this type determines hermetic sealing of the mentioned passage.

The cover blocking the second opening of the casing is fixed to said casing by means of an ultrasonic weld bead or by a mechanical fastening.

In the case of applying a mechanical fastening, it is provided, for example, by a coupling by means of side appendages of the cover which are inserted into the cavity of the casing, flush with two opposite inner walls and anchored on side openings or recesses of said inner walls. If side openings of the casing are present, water can penetrate through said openings, however, the water will run into the mentioned double wall barrier, so the protection of the switch against water is maintained.

Based on what has been explained above, it will be understood that the invention proposes using one and the same flexible element, i.e., the mentioned elastomeric body, to insulate the switch or another electrical or electronic component housed in the cavity of the casing. In this manner, a single elastic element covers one and the same protection against water in two areas, both for the area where the component is installed in the cavity and for the cables, avoiding independent joining elements or any type of adhesives or thermosetting resins which have been used up until now and increase the cost of the assembly.

One advantage of the mentioned solution is that, depending on the technical requirements, it is possible to play with only one element to be replaced, i.e., the elastomeric body.

In addition to watertightness, another advantage is the mechanical protection of the actual electrical or electronic component or device, given that it is protected by elements that can be selected depending on requirements in terms of impact, external resistance, corrosion, etc.

It will be understood that references to geometric positions, such as, for example, parallel, perpendicular, tangent, etc., allow deviations of up to ±5° with respect to the theoretical position defined by said nomenclature.

It will also be understood that any range of values that is offered may not be optimal as regards its end values and may require adaptations of the invention so that said end values are applicable, with said adaptations being within reach of one skilled in the art.

BRIEF DESCRIPTION OF THE DRAWINGS

The foregoing and other advantages and features will be fully understood based on the following detailed description of several embodiments in reference to the attached drawings which must be interpreted in an illustrative and non-limiting manner, in which.

DETAILED DESCRIPTION OF SEVERAL EMBODIMENTS

Figure 1A:
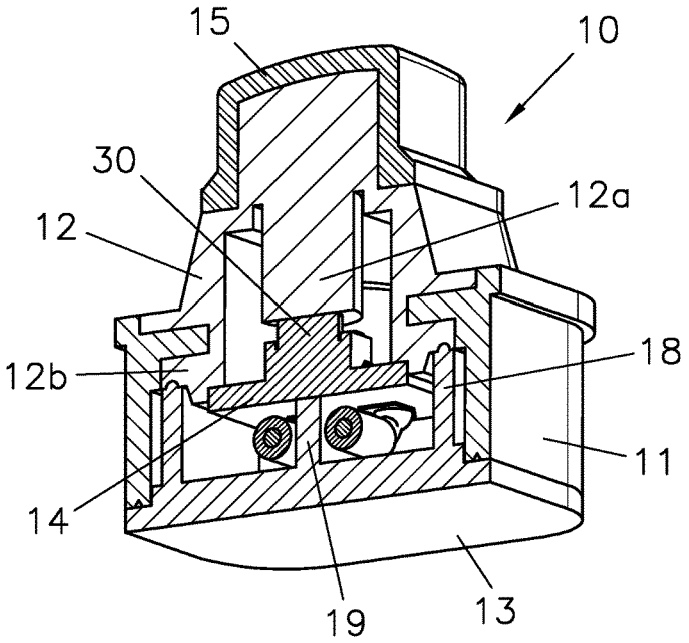
FIG. 1A is a sectioned perspective view of an electric switch assembly of the invention according to a first embodiment.
Figure 1B:
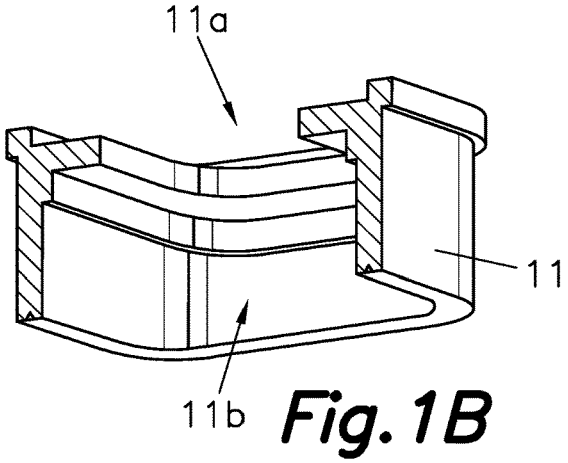
FIG. 1B is a sectioned perspective view of the casing showing the first opening and second opening of the casing.

In the first embodiment shown in FIGS. 1 to 3, a structure and/or design of the mentioned electric switch assembly 10 is proposed, said assembly being envisaged to show an external push button element 15, i.e., the button which the user will push and which will subsequently actuate an electronic push component or device 30 encapsulated inside the switch assembly 10.

Said external push button element 15 and the casing 11 are attached by an elastomeric body 12 which is overmolded with respect to both the element 15 and the casing 11, closing one of its openings, such that the entry of water into the casing and said elastomeric body 12 is prevented as long as there exists between both a chemical adhesion resulting from overmolding and chemical compatibility. A closure cover 13, which will be described in detail below, closes a second opening—of the casing 11, directly opposite the first opening. The elastomeric body comprises a portion 12*a* which is arranged facing a push button part of the electronic push component 30, allowing the actuation thereof upon deformation, acting on the mentioned external push button 15. The part of the elastomeric body 12 which is arranged inside the cavity of the casing furthermore has an annular flange 12*b* which is placed against an inner face of the casing adjacent to the first opening of the casing 11.

Figure 2:
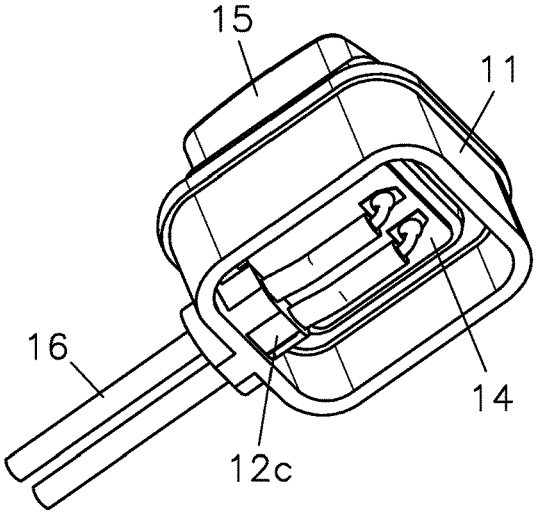
FIG. 2 is a perspective view of the electric switch assembly of FIG. 1A through its lower face, with the closure cover having been eliminated, which allows seeing a printed circuit board supporting the electronic switch component or device, and insulated electric cables which are connected to said board.

FIG. 2 shows the mentioned switch assembly 10 in which the closure cover 13 has been eliminated, which allows seeing (through the second opening 11*b* of the casing 11) inside the cavity of the casing 11 a printed circuit board 14 which supports the electronic switch component or device and to which there are attached by welding the ends of insulated electrical conductors 16 or cables passing to the outside through a side window 17 of the casing 11 which is occupied by an extension 12*c* of the overmolded elastomeric body 12, such that the electrical conductors 16 are embedded through said extension 12*c* (see FIG. 3), and therefore the watertightness of said passage is assured.

The mentioned second opening is closed by the cover 13 which can be sealed by means of ultrasound, by means of a harpoon-type closure (appendages of the cover which are interlocked in the walls of the casing 11), or even by means of an adhesive, this should be avoided.

According to the proposal of this invention, the mentioned cover 13 comprises on its inner face a tubular wall 18 (in this case having a rectangular cross-section) which is inserted into the cavity of the casing 11 until establishing a perimetral interference contact, with its free edge (advantageously having a rounded transverse profile) pressing on a surface of the elastomeric body (provided by the annular flange 12*b* attached by overmolding to the inner face of the cavity of the casing 11, adjacent to the first opening, this tubular wall 18 of the cover 13 completely surrounding the mentioned printed circuit board 14 bearing the electronic push component 30 and fitted in an inner portion of the elastomeric body 12, thereby assuring waterproofness.

Figure 4:
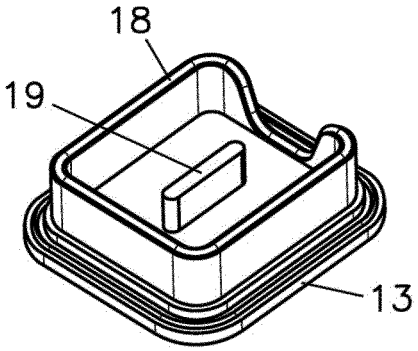
FIG. 4 is a perspective view of the closure cover of the second opening of the casing, showing the tubular wall which is derived from the inner face of this cover and the sealing lip which determines its free edge and will preferably have a rounded cross-section.

Assuring that the elastomeric body 12 is pressed, along the perimeter, into the entire contour of the location of the electronic push component 30 is of utmost importance, and for this reason the tubular wall 18 of the cover 13 must adapt to said elastomeric body 12 despite the existence of changes in height caused by interaction with the insulated electrical conductors 16. FIG. 4 shows the terminal profile of said wall 18, where it can be seen that the wall has a perimetral lip or arch-shaped part designed to allow the passage of the cables 16 therethrough.

Furthermore, in the solution of the first embodiment the cover 13 has a projection or partition 19 located in the central part of its inner face, which projection supports the printed circuit board 14, keeping it in place, fitted in the inner portion of the elastomeric body 12 (see FIG. 1), but at the same time prevents the printed circuit board 14 from having a support and opposite reaction force when a force is imparted on the push button part of the electronic push component 30, and the latter on the printed circuit board 14.

Figure 5:
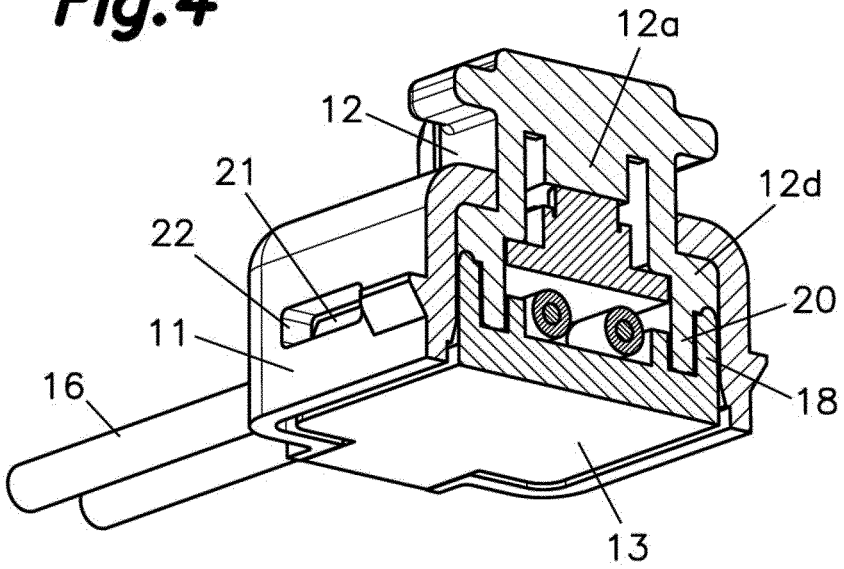
FIG. 5 is a sectioned perspective view of an electric switch assembly of the invention according to a second embodiment.
Figure 6:
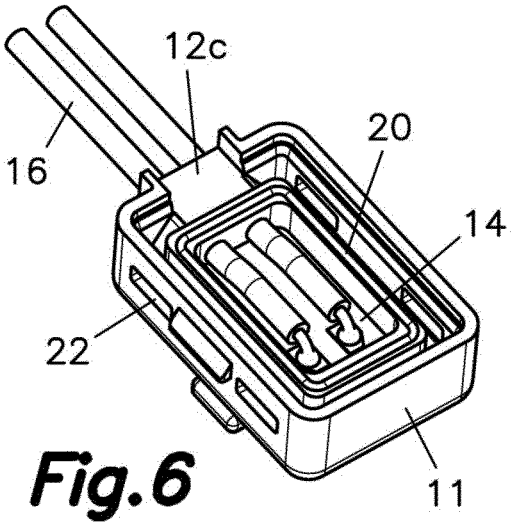
FIG. 6 is a perspective view of the electric switch assembly of FIG. 5 through its lower face, with the closure cover having been eliminated, which allows seeing a printed circuit board supporting the switch, the tubular wall emerging from the elastomeric body surrounding said printed circuit board, and insulated electric cables which are connected to said printed circuit board and extend to the outside, passing through an extension of the elastomeric body which is arranged in a side opening of the casing.
Figure 7:
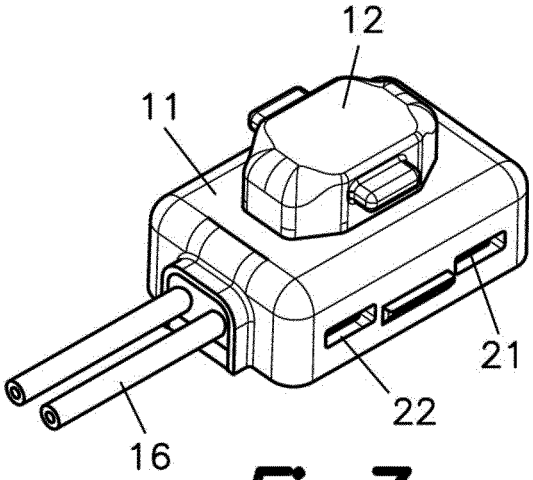
FIG. 7 is a perspective view of the switch assembly of the embodiment of the two preceding figures, showing the push button portion and the insulated electric cable exiting the casing.

FIGS. 5 to 7 show a second embodiment in which the same principle of the invention is applied, although in this case, the elastomeric body 12 does not have to be overmolded, reducing the cost of the manufacturing process as indicated and obtaining similar watertightness conditions.

In this second embodiment, the elastomeric body 12 is introduced in the cavity of the casing 11 with its push button portion emerging through the mentioned first opening 11*a* and being retained therein by the flat face of a bend 12*d* being supported on an inner edge of the cavity adjacent to said opening 11*a*, and the printed circuit board 14 is likewise fitted in the inner portion of this elastomeric body 12, in the area demarcated by the bend 12*d*.

In this case, the cover 13, in addition to having a tubular wall 18, the free edge of which (having a rounded transverse profile) presses on the mentioned flat face of the bend 12*d* of the elastomeric body 12, completely surrounding the electronic component or device of the switch, the polymeric body 12 itself has another tubular wall 20 extending towards the outside of the cavity of the casing 11 until establishing a perimetral interference contact with the inner face of said closure cover 13 of the second opening 11*b*, pressing on said inner face.

As can be seen in FIG. 5, the tubular walls 18 and 20 of the elastomeric body 12 of the cover 13 are of different width, located very close to one another, and fitted together.

The same FIG. 5 shows an example of the cover 13 being attached to the casing 11 by means of an interlocking of grips or appendages 21 of the cover in the side openings 22 of the casing 11. Given the use of the double barrier provided by the mentioned walls 18, 20, the watertightness of the electronic component or device of the switch associated with the mentioned printed circuit board 14 is assured.

FIG. 6 is similar to the view of the mentioned FIG. 2 showing the printed circuit board 14 arranged fitted in the central portion of the elastomeric body 12 which is arranged inside the cavity of the casing 11. The tubular wall 20 which is derived from the elastomeric body 18 and extends to the outside until pressing on the inner face of the cover 13, as explained in reference to FIG. 5, can be seen in this view. The cables 16 exiting through the elastomeric body extending towards a side window made on the casing 11 can also be seen.

Figure 3:
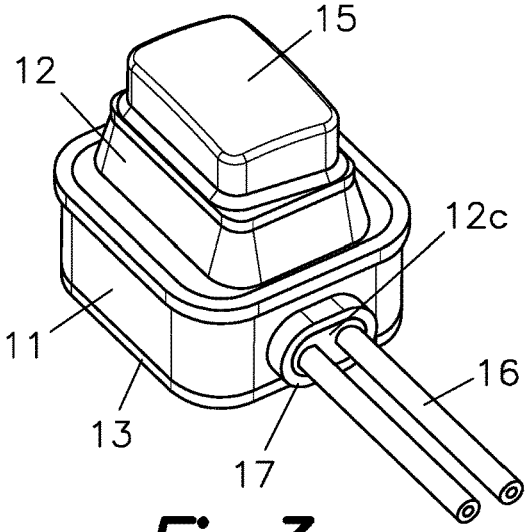
FIG. 3 is a perspective view of the switch assembly of the two preceding figures, showing the push button portion and the insulated electric cables exiting the casing.

FIG. 7 is similar to FIG. 3 and shows the switch assembly with its upper section which works as a push button being seen.

One advantage of this second embodiment is that due to the absence of attachment of the elastomeric body by overmolding, it is not necessary to use elastomers for said elastomeric body which are compatible with the material of the casing, which is usually a polymeric material.

It will be understood that the different parts constituting the invention described in an embodiment can be freely combined with parts described in other different embodiments even though said combination has not been explicitly described, provided that such combination is not detrimental.

Likewise, it must be indicated that the teachings of this invention are applicable for sealing other electrical or electronic components or devices included in a closed compartment from water.

The invention claimed is:

1. A waterproof electric push button switch assembly comprising:

a closed compartment; and a printed circuit board supporting an electronic push component housed inside said closed compartment, said printed circuit board having connected thereto two insulated electrical conductors coming out of said closed compartment, wherein said closed compartment is defined inside a casing comprising a cavity with two openings, a first opening and a second opening, said first opening being hermetically sealed by a compressible elastomeric body having a portion which is arranged facing said electronic push component, said compressible elastomeric body being attached to said casing, and said second opening is hermetically sealed by a cover, said first opening is arranged opposite to said second opening;

said compressible elastomeric body extends partially into said cavity of said casing providing an inner portion with an annular flange which is placed against an inner face of said casing adjacent to said first opening of said casing;

said printed circuit board supporting said electronic push component is fitted in a recessed portion of said compressible elastomeric body; and said cover comprises on an inner face at least one tubular wall which is inserted into said cavity of said casing and establishes with a free edge thereof a perimetral interference contact with a surface of said compressible elastomeric body, said tubular wall of said cover completely surrounding said printed circuit board, and wherein said two insulated electrical conductors come out through a side window of said casing which is occupied by an extension of said elastomeric body and through which said insulated electrical conductors pass.

2. The waterproof electric push button switch assembly according to claim 1, wherein said compressible elastomeric body further comprises a tubular wall extending outside of said cavity of said casing until establishing a perimetral interference contact with the inner face of said cover.

3. The waterproof electric push button switch assembly according to claim 2, wherein said tubular walls of said compressible elastomeric body and of said cover are of different widths and fitted together.

4. The waterproof electric push button switch assembly according to claim 2, wherein said casing is rigid, with said first and second openings arranged opposite one another and said compressible elastomeric body has a bend with a flat inner face which is placed against a part of said inner face of said casing surrounding said first opening, said flat inner face of said bend being pressed by said tubular wall of said cover.

5. The waterproof electric push button switch assembly according to claim 4, wherein said tubular wall of said elastomeric body emerges from said flat inner face of said bend.

6. The waterproof electric push button switch assembly according to claim 1, wherein said printed circuit board is fitted in an inner portion of said compressible elastomeric body.

7. The waterproof electric push button switch assembly according to claim 6, wherein said cover has an inner face, said inner face having, in a central area, a projection extending into said cavity of said casing and providing a support for said printed circuit board.

8. The waterproof electric push button switch assembly according to claim 1, wherein said compressible elastomeric body is made of an elastomeric thermoplastic material operative in a temperature range of −85° C. to +85° C.

9. The waterproof electric push button switch assembly according to claim 1, wherein said casing is a rigid casing, with said first and second openings arranged opposite one another, and said compressible elastomeric body attached to said first opening of said casing by overmoulding, comprising said flange providing said surface, said flange being placed against a part of said inner face of said casing surrounding said first opening.

10. The waterproof electric push button switch assembly according to claim 1, wherein said compressible elastomeric body furthermore has attached thereto by overmoulding an outer part configured as a push button.

11. The waterproof electric push button switch assembly according to claim 1, wherein said cover is fixed to said casing by means of an ultrasonic weld bead.

12. The waterproof electric push button switch assembly according to claim 1, wherein said cover is fixed to said casing by a mechanical fastening.

13. The waterproof electric push button switch assembly according to claim 12, wherein said mechanical fastening is provided by side appendages of said cover which are inserted into said cavity of said casing, adjacent to two opposite inner walls, and anchored inside openings of said walls.

* * * * *